United States Patent [19]
Sequin
[11] 4,210,272
[45] Jul. 1, 1980

[54] CONTAINER LID

[75] Inventor: Maurice Sequin, Windsor, Canada

[73] Assignee: Michael M. Sakovich, Ottawa, Canada

[21] Appl. No.: 919,480

[22] Filed: Jun. 27, 1978

[51] Int. Cl.² ..... B65D 5/66; B65D 5/72
[52] U.S. Cl. ..... 229/7 R; 215/253; 220/90.4; 229/43
[58] Field of Search ..... 229/7 R, 43; 215/253, 215/254; 220/90.2, 90.4, 90.6

[56] References Cited

U.S. PATENT DOCUMENTS

| | | | |
|---|---|---|---|
| 2,261,875 | 11/1941 | Dunn | 215/254 X |
| 3,101,879 | 8/1963 | Meyer-Jagenberg | 229/7 R |
| 3,301,459 | 1/1967 | Gardner | 229/7 R |
| 3,321,104 | 5/1967 | Edwards | 229/43 |
| 3,421,681 | 1/1969 | Frank | 229/43 |
| 3,446,383 | 5/1969 | Hannon | 215/253 |
| 3,938,695 | 2/1976 | Ruff | 229/7 R X |
| 3,977,559 | 8/1976 | Lombardi | 229/7 R X |
| 3,994,411 | 11/1976 | Elfelt et al. | 229/7 R X |
| 4,090,660 | 5/1978 | Shrom et al. | 215/253 X |
| 4,113,135 | 9/1978 | Yamazaki | 229/7 R X |

FOREIGN PATENT DOCUMENTS

| | | | |
|---|---|---|---|
| 952962 | 3/1964 | United Kingdom | 215/253 |

*Primary Examiner*—Stephen P. Garbe
*Attorney, Agent, or Firm*—Michael M. Sakovich

[57] ABSTRACT

A container lid is formed from a disc having thin walls of uniform thickness throughout which span and overlap the open end of the container. The overlapping portion includes a downwardly depending resilient skirt that partly overlies in engaging relation one surface of the sidewall adjacent the open end. Complementary engagement means are formed in the skirt for releasably engaging lid engagement means such as a continuous bead or groove that comprise an integral part of the container. A reclosable tear strip defines an opening through which the contents of the container may be discharged and forms an integral part of the disc and the skirt. The strip has sides defined by fracture lines formed in the disc, an outer end defined by the lines extending into the skirt to include the complementary engagement means and an inner end forming a hinge along a weakened line in the disc. In one embodiment the tear strip extends to the bottom edge of the skirt while in another, the strip ends before the edge to form a continuous reinforcement band around the container.

14 Claims, 7 Drawing Figures

CONTAINER LID

BACKGROUND OF THE INVENTION

This invention relates to a container lid and more particularly to a container lid having a reclosable tear strip defining an opening through which the contents of the container may be discharged.

Disposable containers are used widely in the convenience food industry where prepackaged foodstuffs are transported, stored and even cooked in the same container. Beverages, in particular, are commonly dispensed in disposable containers which are generally provided with a cover or lid that may serve several useful functions. After a beverage container is filled the container is easily closed using a known lid to prevent spilling the contents as when a beverage is purchased at a retail counter and taken by the purchaser for subsequent consumption. This is the usual case when coffee, soft drinks, and the like are sold at sports events, theaters and any other similar function where the general public may gather.

The container lid is adapted to provide a good seal along the circumferential edge of a sidewall that defines the open end of a container. Apart from a small vent aperture in the lid that is used to equalize the interior pressure of the container with its surrounding environment, the seal formed at the edge is normally adequate to prevent leaks. When a beverage is purchased at a counter and then taken, as to a seat in a stadium, the likelihood of a spill while being jostled in the crowd is thus minimized. In the event that the beverage is to be consumed while being taken to the seat, spills may also be prevented by using a straw that is forced through a frangible portion of the lid. A relatively good seal is maintained by the fit of the straw through the lid so that leakage at this area as well as at the vent aperture is minimal. It is therefore unlikely that a major spill would occur.

A problem exists, however, when a beverage is consumed directly from the cup without using a straw. Consumption of certain liquids, such as beer, requires direct consumption rather than consumption through a straw due to the very nature of the beverage. In this situation there is a strong likelihood of spilling the beverage onto a neighbor in the envent of being severely jostled in the crowd since the container lid would normally be removed. Spills are minimized using known container lids that incorporate tear strips which are readily removed to expose a discharge opening. A problem that can be experienced with this form of container lid occurs when transporting the container and its beverage with the tear strip removed. Since the opening is relatively large, an accidental bump can still lead to a substantial portion of the beverage being spilled, possibly on a bystander.

Another problem that can be experienced with disposable containers of the prior art, notably those that are made from styrofoam, is that such containers may fracture if unduly squeezed, a condition that may readily occur in view of the flexible nature of the sidewalls of the container. While this condition is alleviated somewhat by virtue of the lid gripping the open end of the container, removal of the tear strip weakens the lid and increases the risk of a sidewall fracture.

SUMMARY OF THE INVENTION

A principal object of the present invention is to provide a lid for a container having a reclosable tear strip that forms an integral part of the lid.

Another object of the invention is to provide the lid with thin walls of uniform thickness throughout.

Another object of the invention is to provide the tear strip with a hinged end formed in the lid and an outer end which is adapted to engage lid engagement means that are formed in the sidewall of the container.

Still another object of the inventin is to provide such a lid with a continuous reinforcement band that is adapted to engage the exterior periphery of the container adjacent its open end.

The problems associated with the prior art may be substantially overcome and the foregoing objects achieved by recourse to the invention which is a lid for a container having an open end defined by a circumferential edge of a sidewall including lid engagement means. The lid comprises a disc having thin walls of uniform thickness throughout for spanning and overlapping the open end, the overlapping portion including a downwardly depending resilient skirt adapted to partly overlie in engaging relation one surface of the sidewall adjacent the edge. Complementary engagement means are formed in the skirt for releasably engaging the lid engagement means, and a reclosable tear strip forms an integral part of the disc and the skirt, the strip having sides defined by fracture lines formed in the disc, an outer end defined by the lines extending into the skirt to include the complementary engagement means, and an inner end forming a hinge along a weakened line in the disc. Moreover, the lines extending into the skirt terminate at a slot having an upper edge defining the outer end below the complementary engagement means, and a lower edge bounding one side of a strip defined by the lower edge of the slot and a bottom edge of the skirt. The lid further comprises means for venting the container.

DESCRIPTION OF THE DRAWINGS

The invention will now be more particularly described with reference to embodiments thereof shown, by way of example, in the accompanying drawings in which.

DESCRIPTION OF THE ILLUSTRATED EMBODIMENTS

Figure 1:
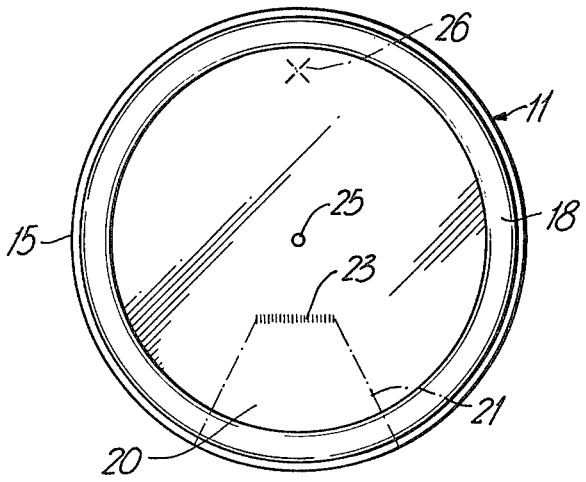
FIG. 1 is a fragmentary side elevation view of a container having a lid with a reclosable tear strip according to the invention.

A side elevation view in FIG. 1 illustrates a container in the form of a styrofoam beverage cup 10 of a type that is commonly used to dispense hot beverages such as coffee and tea. The cup is also suitable for other beverages as well as foods including soup, and may even be used to dispense solids such as items of confection. A lid 11 is fabricated from a disc having thin walls of uniform thickness throughout which span and overlap the open end of the container as shown. It will be observed that the overlapping portion includes a downwardly depending resilient skirt 12 which is adapted to partly overlie in engaging relation an exterior surface 13 of the cup 10.

Figure 3:
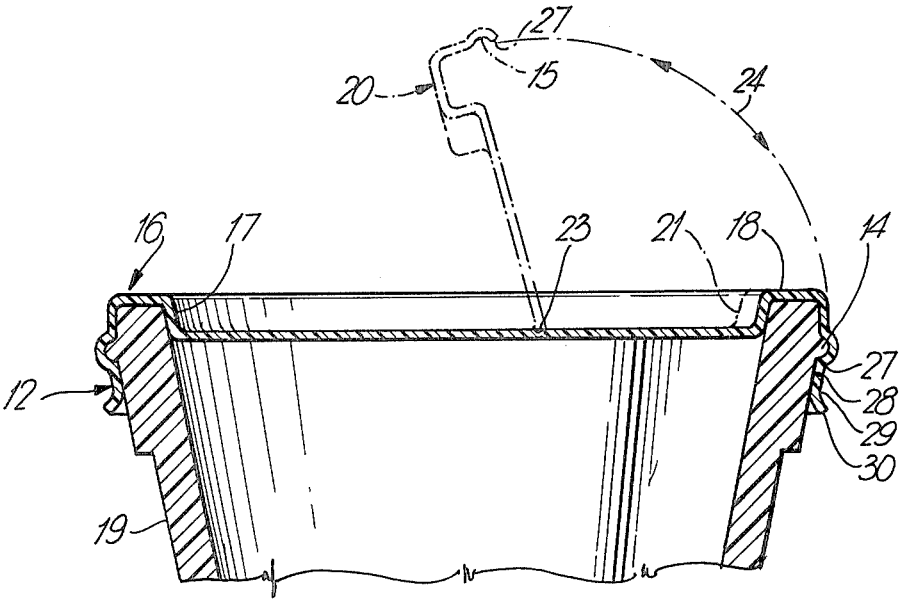
FIG. 3 is a cross sectional view taken along the lines 3—3 of FIG. 1.

Lid engagement means are formed in a sidewall 19 of the cup 10 in FIG. 1 comprise a continuous outstanding bead 14. Reference to FIG. 3, which is drawn to a greater scale, shows this and other characterizing features of the cup and lid 11 in larger detail.

Reference to the fragmentary sectional views of FIGS. 1 and 3 illustrates the manner in which the skirt 12 partly overlies in engaging relation the bead 14 and the surface 13 adjacent the open end of the cup 10. Thus, it will be observed that complementary engagement means which are formed in the skirt 12 for releasably engaging the bead 14 comprise a continuous groove 15 that faces inwardly of the lid on an inner surface of the skirt. The groove 15 is adapted to fit the bead 14 and together they comprise a tongue-and-groove joint to hold the lid securely in place.

The fragmentary sectional views of these figures also show that the lid 11 provides an additional complementary engagement means in the form of an annular channel 16. The channel comprises an outer wall formed by the skirt 12 and a concentric inner wall 17 that depends downwardly from a lid portion 18 overlying the circumferential edge of the sidewall 19.

Figure 2:
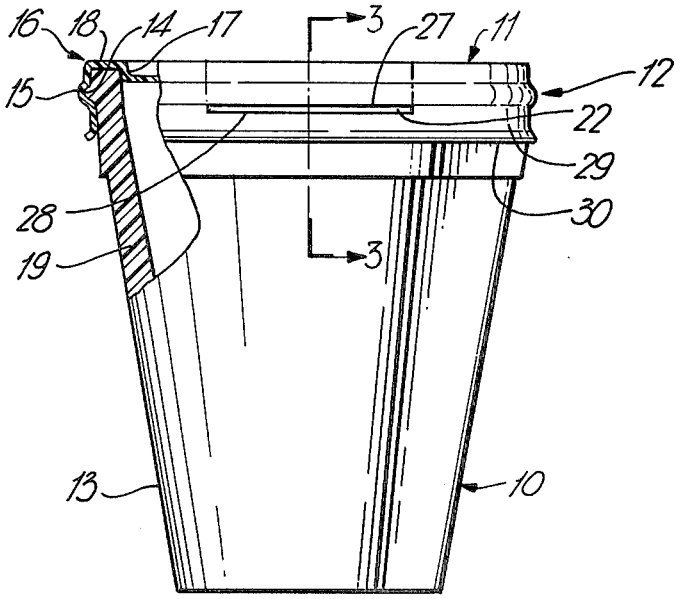
FIG. 2 is a top plan view of the lid shown in FIG. 1.

The various structural characteristics of the lid 11 will be noted in the plan view of FIG. 2 together with the enlarged sectional view of FIG. 3. Reference to these figures will show a reclosable tear strip 20 that forms an integral part of the disc from which the lid 10 is formed. It will be noted that the strip 20 has sides defined by fracture lines 21 that are formed in the lid and which extend into the skirt 12, terminating below the bead 14 at a slot 22. An inner end of the strip 20 forms a hinge along a weakened line 23 which retains the strip 20 in attached relation to the lid 11 after the strip sides are torn free from the lid to define a discharge opening. Reference to FIG. 3 shows the open position of the strip 20 in broken line form and a double-headed arrow 24 indicates the path of travel taken by the groove 15 in the skirt portion of the strip 20 when the strip is reclosed. The resilient nature of the lid 11 which is preferably made from thermoplastic material such as polystyrene, polyethylene or other similar plastic materials, permits the skirt portion of the strip 20 to flex outwardly and to releasably engage the bead 14 when the strip is closed.

In addition to the opening provided by the strip 20, there will be observed in FIG. 2 means for venting the interior of the cup 10. This is provided by a centrally located aperture 25. Fracture lines 26 in the form of a cross are formed in the lid 11 and comprise a perforatable aperture through which a straw (not shown) may be admitted into the covered cup 10.

It will be understood that an outer end of the strip 20 includes the skirt portion illustrated in FIG. 1 and which is defined by the lines 21 extending into the skirt 12 to include the groove 15 thereof. The lines 21 terminate at the slot 22 which has an upper edge 27 that defines the outer end of the strip 20 below the groove 15. A lower edge 28 bounds one side of a strip 29 which is defined by the edge 28 and a bottom edge 30 of the skirt. Thus, the strip 29 and the remainder of the skirt 12 comprise a continuous resilient band that grips a corresponding portion of the outer surface of the sidewall 19. In this way the band reinforces the relatively weak open end of the cup 10 which reduces the incidence of fractures occurring in the sidewall 19 while the lid 11 is in position as indicated in the drawings.

Examples of other embodiments of the lid 11 are shown in FIGS. 4 through 7 where structural features which are common or similar have the same numerical designations. Fragmentary views only are shown since this is sufficient to illustrate various lid engagement means formed in the sidewall 19 and complementary engagement means formed in the skirt 12. In each of FIGS. 4, 5 and 6 the skirt 12 is shown in a fragmentary cross sectional view as having a continuous outstanding bead 31 that faces inwardly of the lid 11 on an inner surface of the skirt adjacent the bottom edge 30. Since the wall of the skirt 12 is resilient, it will be understood that the bead 31 exerts an inward radial pressure to grip the sidewall.

Figure 4:
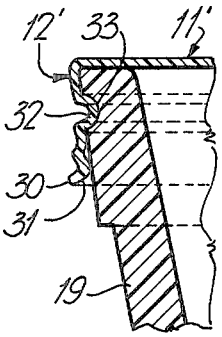
FIG. 4 is a partial cross sectional view showing another embodiment similar to that shown in FIG. 3.

Referring now to FIG 4, the complementary engagement means formed in the skirt 12' comprises a continuous outstanding tongue 32 that faces inwardly of the lid on an inner surface of the skirt. It will be observed that the tongue 32 fits a complementary groove 33 in the outer surface of the sidewall 19.

Figure 5:
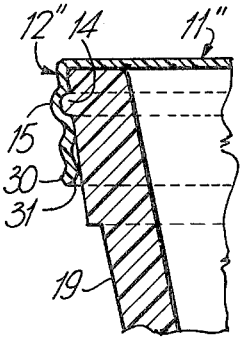
FIG. 5 is a partial cross sectional view of another embodiment similar to that shown in FIG. 3.

A reverse locking arrangment between the lid 11'' and the cup 10 is shown in FIG. 5. Therein, as in the embodiment illustrated in FIG. 3, the complementary engagement means in the skirt 12 comprises a continuous groove 15 that faces inwardly of the lid 11 on the inner surface of the skirt. The groove 15 is adapted to fit a complementary bead 14 outstanding from the outer surface of the sidewall 19.

Figure 6:
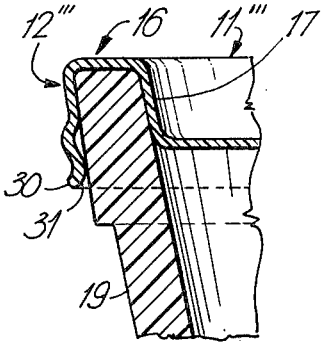
FIG. 6 is still another partial cross sectional view of still another embodiment similar to that shown in FIG. 3.

The arrangement of FIG. 6 differs somewhat by employing an annular channel 16 that is formed in the lid 11'''. The channel includes an outer wall that comprises the skirt 12''' and a concentric inner wall 17 which is similar to that described in the embodiment of FIG. 3.

The embodiments of FIGS. 4, 5 and 6 may be advantageously provided with the slot 22 which identifies the outer end of the strip 20, the upper edge 27 of the slot providing a convenient fingernail grip to permit tearing free the strip 20 along its lines 21.

Although not indicated in the drawings, the embodiments of FIGS. 4, 5 and 6 may be modified slightly as, for example, by eliminating the slot 22 and substituting therefor a fracture line 21. In another variation, the strip 29 may be eliminated together with the slot 22 by extending the lines 21 down to the bottom edge 30 of the skirt. In this instance, the outer end of the strip 20 may be easily identified by forming a notch in the edge 30 between the lines 21 that define the sides of the strip 20. Alternatively, the outer end of the strip 20 may be shaped and turned outwardly in a radial direction to form a pull-tab 35 as illustrated in FIG. 7.

Figure 7:
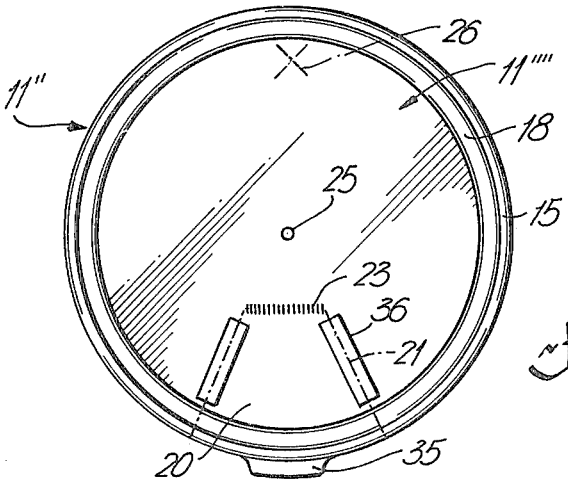
FIG. 7 is a top plan view of another lid embodiment.

Reference to FIG. 7 shows still another variation of the lid 11, one having adhesive strips 36 overlying the fracture lines 21 to provide an improved liquid seal when the strip 20 is reclosed. Proper release of each strip 36 from the lid when the strip 20 is raised occurs by way of differential bonding. Thus, a portion of each strip 36 overlying the strip 20 is permanently bonded thereto in a known manner. Conversely, the portion of each strip 36 overlying the lid 11'''' is releasably bonded thereto in the manner of adhesive tape to facilitate resealing the strip 20 when it is reclosed.

All of the illustrated embodiments of the invention are shown with cups having relatively thick sidewalls 19 as in styrofoam and glass cups. It will be understood, however, that the lid 11 has equal application with cups and other containers having thin sidewalls fabricated from paper, solid plastics such as styrene, and the like.

Having regard to the description and illustrations of the present invention, it will be apparent to those skilled in the art that variations thereof are within the scope of the invention and are readily feasible. Accordingly, the disclosed and illustrated embodiments herein should be considered as exemplary rather than restrictive of the invention which is defined in the accompanying claims.

What I claim:

1. A lid for a container having an open end defined by a circumferential edge of a sidewall including lid engagement means, the lid comprising:

a disc having thin walls of uniform thickness throughout for spanning and overlapping the open end, the overlapping portion including a downwardly depending resilient skirt adapted to partly overlie in engaging relation one surface of the sidewall adjacent said edge;

complementary engagement means formed in the skirt for releasably engaging the lid engagement means;

a reclosable tear strip forming an integral part of the disc and said skirt, the strip having sides defined by fracture lines formed in the disc, an outer end defined by said lines extending into the skirt to include said complementary engagement means, an inner end forming a hinge along a weakened line in said disc and wherein said lines extending into the skirt terminate at a slot having an upper edge defining the outer end below said complementary engagement means, and a lower edge bounding one side of a strip defined by the lower edge of the slot and a bottom edge of the skirt; and means for venting the container.

2. A lid as claimed in claim 1 further comprising a perforatable aperture defined by fracture lines.

3. A lid as claimed in claim 2 wherein said strip and the remainder of the skirt comprise a continuous resilient band adapted to grip a corresponding portion of the outer surface of the sidewall.

4. A lid as claimed in claim 3 wherein the complementary engagement means comprise a continuous outstanding tongue facing inwardly of the disc on an inner surface of the skirt, said tongue being adapted to fit a complementary groove in the outer surface of the sidewall.

5. A lid as claimed in claim 3 wherein the complementary engagement means comprise a continuous groove facing inwardly of the disc on an inner surface of the skirt, said groove being adapted to fit a complementary tongue outstanding from the outer surface of the sidewall.

6. A lid as claimed in claim 3 wherein the complementary engagement means comprise an annular channel formed in the disc, said channel having an outer wall comprising the skirt and a concentric inner wall depending downwardly from a disc portion overlying said edge of the sidewall, the inner wall being resilient and partly overlying in engaging relation the inner surface of the sidewall adjacent said edge.

7. A lid as claimed in claim 3 wherein the complementary engagement means comprise:

a continuous groove facing inwardly of the disc on an inner surface of the skirt, said groove being adapted to fit a complementary tongue outstanding from the outer surface of the sidewall; and an annular channel formed in the disc, said channel having an outer wall comprising the skirt and a concentric inner wall depending downwardly from a disc portion overlying said edge of the sidewall, the inner wall being resilient and partly overlying in engaging relation the inner surface of the sidewall adjacent said edge.

8. A lid as claimed in claim 7, further comprising:

an adhesive strip overlying a portion of each fracture line defining a side of the tear strip, each adhesive strip having a portion permanently bonded to the tear strip and a corresponding portion releasably bonded to the disc to facilitate resealing the tear strip when it is reclosed.

9. A lid as claimed in claim 3 wherein the skirt engages the outer surface of the sidewall along a continuous outstanding bead facing inwardly of the disc on an inner surface of the skirt adjacent the bottom edge thereof.

10. A lid as claimed in claim 9, further comprising:

a pull-tab disposed at the outer end of the tear strip and providing a finger grip thereat; and an adhesive strip overlying a portion of each fracture line defining a side of the tear strip, each adhesive strip having a portion permanently bonded to the tear strip and a corresponding portion releasably bonded to the disc to facilitate resealing the tear strip when it is reclosed.

11. A lid as claimed in claim 10 wherein the complementary engagement means comprise a continuous outstanding tongue facing inwardly of the disc on an inner surface of the skirt, said tongue being adapted to fit a complementary groove in the outer surface of the sidewall.

12. A lid as claimed in claim 10 wherein the complementary engagement means comprise a continuous groove facing inwardly of the disc on an inner surface of the skirt, said groove being adapted to fit a complementary tongue outstanding from the outer surface of the sidewall.

13. A lid as claimed in claim 10 wherein the complementary engagement means comprise an annular channel formed in the disc, said channel having an outer wall comprising the skirt and a concentric inner wall depending downwardly from a disc portion overlying said edge of the sidewall, the inner wall being resilient and partly overlying in engaging relation the inner surface of the sidewall adjacent said edge.

14. A lid as claimed in claim 10 wherein the complementary engagement means comprise:

a continuous groove facing inwardly of the disc on an inner surface of the skirt, said groove being adapted to fit a complementary tongue outstanding from the outer surface of the sidewall; and an annular channel formed in the disc, said channel having an outer wall comprising the skirt and a concentric inner wall depending downwardly from a disc portion overlying said edge of the sidewall, the inner wall being resilient and partly overlying in engaging relation the inner surface of the sidewall adjacent said edge.

* * * * *